United States Patent [19]

Kaspar

[11] Patent Number: 5,016,146

[45] Date of Patent: May 14, 1991

[54] REFRIGERATOR LIGHT ASSEMBLY WITH BULB INSULATING AND PROTECTIVE SLEEVE

[75] Inventor: Melvin Kaspar, La Grange Park, Ill.

[73] Assignee: Ardco, Inc., Chicago, Ill.

[21] Appl. No.: 418,590

[22] Filed: Oct. 10, 1989

[51] Int. Cl.[5] ..... F21V 33/00

[52] U.S. Cl. ..... 362/92; 362/223; 362/376; 362/432

[58] Field of Search ..... 362/92, 217, 223, 260, 362/125, 255, 376, 377, 378, 219, 390, 396, 427, 457, 432; 312/223, 236

[56] References Cited

U.S. PATENT DOCUMENTS

| | | | |
|---|---|---|---|
| 2,537,525 | 1/1951 | Grindstaff et al. | 362/125 |
| 2,687,516 | 8/1954 | Schneiderman | 362/377 |
| 3,612,848 | 10/1971 | Koch et al. | 362/92 |
| 4,229,780 | 10/1980 | Nelson | 362/376 |
| 4,945,461 | 7/1990 | Crates | 362/376 |

FOREIGN PATENT DOCUMENTS

| | | | |
|---|---|---|---|
| 2200200 | 7/1988 | United Kingdom | 362/378 |

*Primary Examiner*—Stephen F. Husar
*Assistant Examiner*—D. M. Cox
*Attorney, Agent, or Firm*—Leydig, Voit & Mayer

[57] ABSTRACT

A refrigerator cabinet light fixture assembly comprising an elongated base with an electrical socket at each end thereof, an elongated bulb supported between the sockets, and a clear plastic tubular sleeve concentrically supported about the bulb for defining an air insulating space therebetween. A plurality of stabilizing members are mounted on the base member intermediate the ends of the tubular sleeve for engaging the tubular sleeve and preventing relative movement between the sleeve and bulb for enabling the sleeve to protect the bulb from damaging impact of forces striking the exterior of the sleeve. The stabilizing members each have a base fixed to the light fixture base member and an outwardly extending sleeve engaging arm mounted for pivotal movement between an operative tubular sleeve engaging and retaining position and a retracted position out of engagement with the tubular sleeve for permitting removal of the sleeve and bulb from the fixture.

20 Claims, 1 Drawing Sheet

REFRIGERATOR LIGHT ASSEMBLY WITH BULB INSULATING AND PROTECTIVE SLEEVE

DESCRIPTION OF THE INVENTION

The present invention relates generally to refrigerator and freezers, and more particularly, to lighting fixtures disposed within commercial refrigerator and freezer installations for illuminating items displayed therein.

Commercial refrigerator and freezers, such as used in modern self-service supermarket-type retailing, commonly comprise a cabinet structure having a plurality of pivotably mounted insulated glass door assemblies. Items within the refrigerator or freezer, such as packaged meats, produce, beverages (liquid and frozen), eggs and the like, are displayed on wire shelves or racks. The insulated glass doors typically include a plurality of laterally spaced glass panes that permit items within the refrigerator or freezer to be conveniently viewed by the discerning shopper while the doors are in a closed condition. It not only is important that such commercial refrigerators and freezers maintain the merchandise at the desired refrigerated temperature on a cost efficient basis, but also that they attractively display the items contained therein. For this purpose, it is customary to mount light fixtures immediately behind the doors for illuminating items on the display shelves. To provide the desired illuminating effect, with the light source being inconspicuous to the shopper, the light fixtures typically are of a fluorescent type which extend between top and bottom perimeters of the refrigerator cabinet immediately behind the mullions or vertical frame members of the door assembly.

Since such fluorescent lights do not operate well at low temperatures, it is customary to mount the bulb of the light fixture within a clear plastic, elongated tubular jacket or sleeve to insulate it from the temperature within the refrigerator cabinet. Because the light fixture is disposed in close relation between the door frame and refrigerator shelving, however, the light fixture is often struck by items being loaded into and removed from the shelves. To protect the bulb from breakage, it is been necessary to provide a separate guard, such as a wire cage or screen, in surrounding relation about the bulb and plastic insulating sleeve.

Due to space limitations between the shelving and the door frame, it has been difficult to install such guards without modification to the shelving or the door frame. Moreover, once installed, such protective guards encumber removal and replacement of the bulb from the light fixture, as is periodically necessary. When efforts heretofore have been made to utilize the plastic insulating sleeve as a protective device for the light bulb so as to eliminate the need for a separate guard, such efforts have not been successful. Because of the relatively long length of the bulb, and hence the clear-plastic insulating sleeve, the sleeve generally has insufficient strength to shield the bulb from impact when struck by items being loaded into and removed from the refrigerator. Even when efforts have been made to utilize thicker, more rigid, plastic tubular insulating sleeves, such sleeves have not been reliable in protecting the light fixture from damage. Because the sleeve extends between sockets at the opposed ends of the light fixture, forces striking the rigid sleeve are absorbed by the sockets. After prolonged use in commercial refrigerator installations, repeated impact against the relatively fragile sockets often causes breakage of the sockets, or loosening of the electrical contacts therein, rendering the light fixture inoperative.

It is the object of the present invention to provide a light fixture for commercial refrigerator and freezer cabinets that is adapted to both insulate the lamp bulb from cold temperatures within the cabinet and to protect it from damage caused by the impact of items being loaded into and removed from the refrigerator, without the use of a separate wire guard or the like.

Another object is to provide a refrigerator cabinet light fixture as characterized above which may be installed in close relation between the refrigerator door frame and the shelving within the cabinet without modification to the shelving or door frame.

A further object is to provide a refrigerator light fixture of the foregoing type which permits easy removal and replacement of the bulb.

Still another object is to provide a refrigerator light fixture of the above kind which is relatively simply in construction and installation and lends itself to economical manufacture.

Yet another object is to provide such a refrigerator light fixture which permits the use of a relatively thin-gauge tubular insulating sleeve.

Other objects and advantages of the invention will become apparent upon reading the following detailed description and upon reference to the accompanying drawings, wherein.

Figure 1:
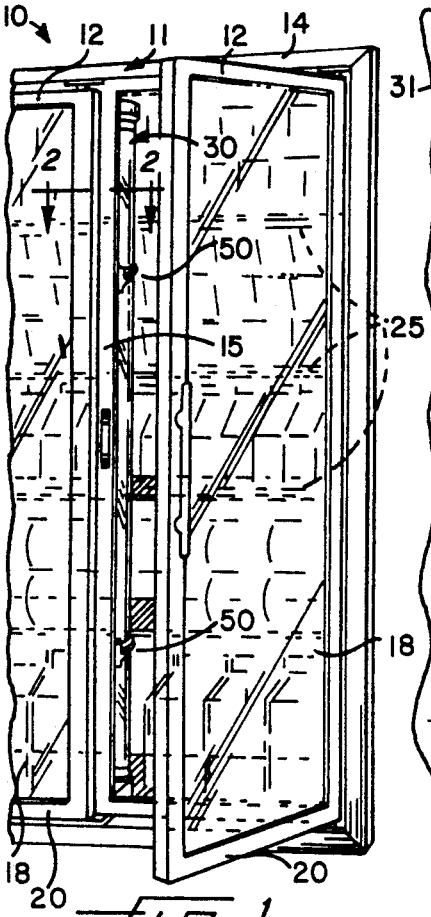
FIG. 1 is a perspective of a commercial refrigerator having light fixtures in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrative refrigerator 10 which includes a refrigerator door assembly 11, comprising a plurality of insulated glass doors 12 mounted for swinging movement in a door mounting frame 14, which in turn is mounted within a front wall opening of a refrigerator cabinet or the like. The door mounting frame 14 extends about the perimeter of the opening in the wall and includes one or more mullions 15 disposed vertically between the top and bottom of the frame 14 to provide rigidity to the frame 14 and define a sealing surface against which the free swinging sides of the doors 12 engage when in a closed condition. It will be understood that such door assembly 11 maybe mounted in a free standing refrigerator or freezer case or built-in cooler or cabinet of the type used in supermarkets and retail stores to display refrigerated or frozen items.

The insulated glass doors 12 maybe of a conventional type, which include an insulated glass unit 16 comprising a plurality of glass panes 18 disposed in parallel side by side relation separated by spacers 19. For supporting the glass unit 16 and providing a decorative finish trim about the outer perimeter thereof, each door has an outer frame assembly 20, the rear side of which carries a gasket 21 adapted for sealing engagement with the door frame 14.

For supporting merchandise within the refrigerator cabinet, a plurality of shelves 25, such as the wire mesh type, are provided. The shelves 25 typically are supported on front and rear support posts or standards, the front posts being secured to the door frame by brackets 28 or other suitable means.

To illuminate merchandise within the refrigerator cabinet, one or more vertical light fixtures 30 are supported rearwardly of the door frame 14 immediately in front of the shelves 25. Each light fixture 30 in this instance comprises an elongated channel shaped base 31 with rearwardly extending socket supports 32 at top and bottom ends thereof which each have an electrical socket 34. A replaceable light bulb 35, which may be of a fluorescent type, is supported between the sockets 34. The light fixture base 31 is fixed to the rear side of the door frame mullion 15 by suitable mounting fasteners and may be connected to an electrical outlet on the mullion, as is known in the art.

In order to insulate the bulb 35 from the refrigerated temperatures within the cabinet, a clear-plastic, elongated tubular sleeve 36 is concentrically mounted about the bulb 35 so as to define an air insulating space 38 between the bulb 35 and sleeve 36. The insulating sleeve 36 may be made of relatively thin gage (i.e. 0.060 inch) polycarbonate material. For supporting the insulating sleeve 36 concentrically about the bulb 35, a pair of end caps 40 are provided at opposed ends of these sleeve 36. Each end cap 40 has a first tubular portion 41 over which an end of the sleeve 36 is snuggly positioned and a radial locating flange 42 against which the end of the sleeve abutts. The end cap 40 has a second tubular portion 44 with an end wall formed with an elongated opening 45 through which the terminals of the bulb 35 are positionable to contact with the socket.

In accordance with the invention, stabilizing means are provided intermediate the ends of the tubular sleeve for preventing movement of the sleeve when struck by items being loaded into and removed from the refrigerator, and hence, for enabling the sleeve to shield the bulb from the potentially damaging impact from such forces. In the illustrated embodiment, the stabilizing means comprise one or more stabilizing members 50 which are affixed to the light fixture base 31 and which engage the tubular plastic sleeve 36 for preventing relative movement of the sleeve 36 with respect to the base 31 and the bulb 35 supported thereby. Each stabilizing member 50 in this case has a mounting base 51 and a rearwardly extending stabilizing arm 54 for engaging and retaining the sleeve 36. The mounting base 51 is secured to the light fixture base 35 by a stud 52 that extends through the light fixture base 35 and into threaded engagement with the mullion 15. To facilitate mounting of the stabilizing member 50 on the light fixture base 31 with the arm 54 properly positioned with respect to the sleeve 36, the stabilizing member base 51 is formed with a channel recess 55 on the mounting side thereof which defines a pair of locating flanges 56 that are positionable adjacent opposite sides of the light fixture base 31.

For engaging and retaining the tubular plastic sleeve 36, the stabilizing arm 54 is formed with a sleeve - receiving cylindrical recess 58 corresponding in size to the diameter of the sleeve 36. The cylindrical recess 58 preferably encompassess the forward one half (i.e. or about 180 degrees) of the outer periphery of the sleeve 36. The stabilizing member 50 preferably is made of rigid plastic material, and the arm 54 has a thickness "t", such as on the order of 3/16 inch, so as not to cut into the relatively thin walled plastic sleeve 36. The inherent resiliency of the sleeve 36 enables it to be snuggly positioned into and retained by stabilizing arm recess 58.

Figure 3:
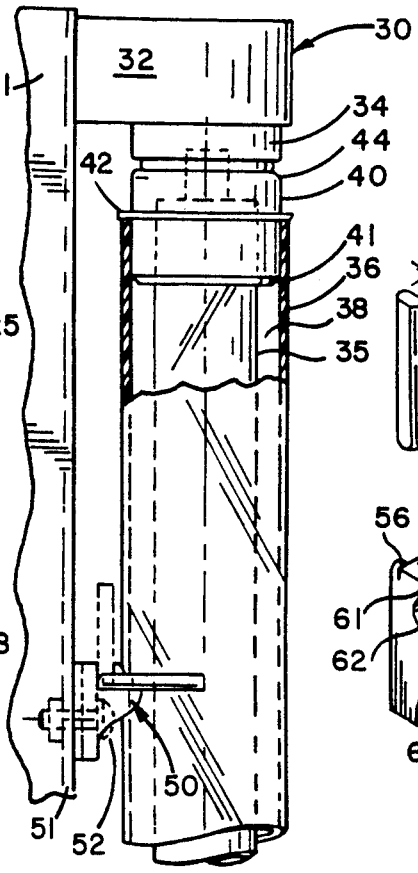
FIG. 3 is a fragmentary side elevation view of the upper end of one of the illustrated light fixtures, taken in a plane of line 3—3 in FIG. 2.
Figure 6:
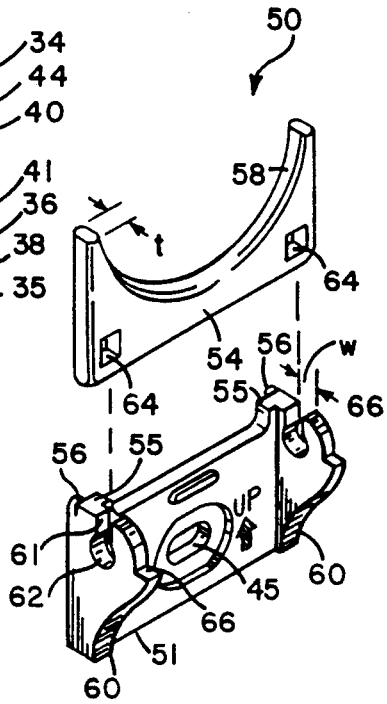
FIG. 6 is an exploded view of the component parts of the stabilizing member.
Figure 2:
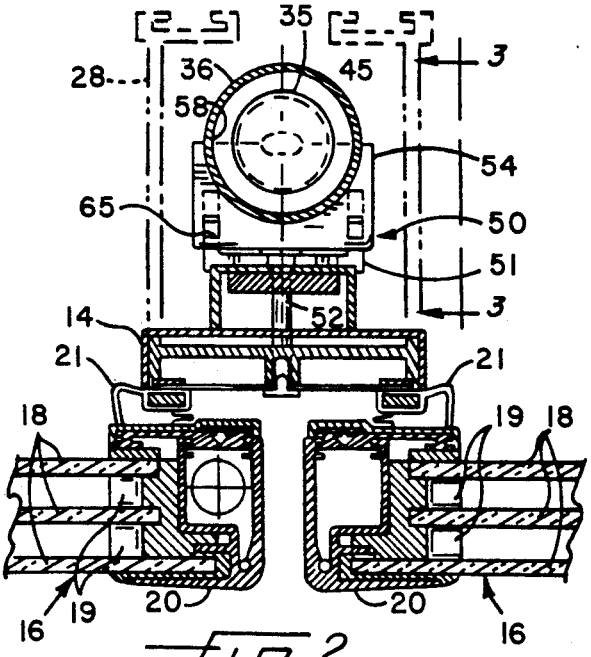
FIG. 2 is an enlarged fragmentary section taken in the plane of line 2—2 in FIG. 1.
Figure 4:
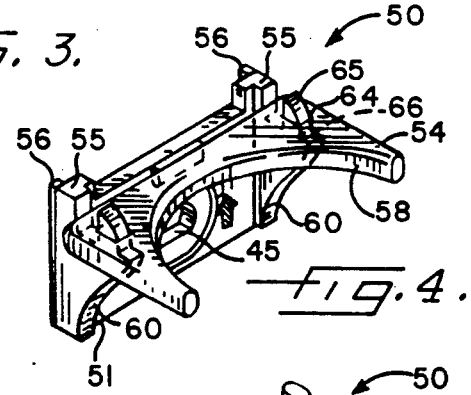
FIG. 4 is an enlarged perspective of one of the tubular insulating sleeve stabilizing members associated with the illustrated light fixture, with the stabilizing arms thereof in operative position.
Figure 5:
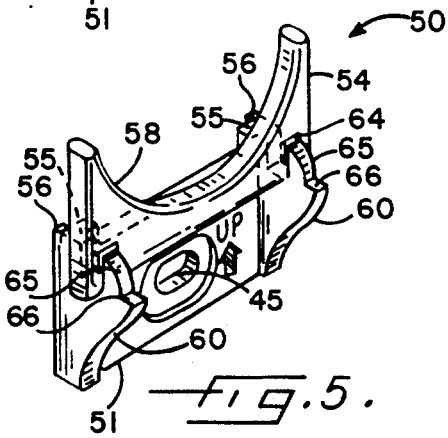
FIG. 5 is a perspective, similar to FIG. 4, but showing the stabilizing arm of the member in an inoperative position to facilitate removal and replacement of the bulb of the light fixture.

In accordance with a further feature of the invention, the stabilizing arm 54 is moveable between an operative sleeve engaging and stabilizing position and a inoperative retracted position which permits easy removal and replacement of the bulb 35. The stabilizing arm 54 in the illustrated embodiment is pivotally mounted on the base 51 for movement between an operative position, extending in perpendicular relation to the base member 51, as shown in FIGS. 3 and 4, and an upright or retracted position in a plane parallel to the base member 51, as shown in FIG. 5 and in phantom in FIG. 3.

For supporting the stabilizing arm 54 for pivotal movement relative to the base member 51, the base member 54 in this case has integral formed, rearwardly extending arm support flanges 60 on opposite sides thereof. Each flange 60 is formed with an upwardly opening slot 61 having a width "w" slightly less, or substantially equal, to the thickness "t" of the respective stabilizing arm 54 such that the arm 54 can be forcefully and snuggly positioned into the channel 60, but yet can be pivotally moved with respect thereto. To facilitate such pivotal movement, the bottom of each channel 60 is formed with a slightly enlarged cylindrical bottom 62. To permit pivotal movement of the stabilizing arm 54 without interference with the support flanges 60, the arm 54 is formed with apertures 64 though which upwardly extending portions 65 of the mounting flanges 60 extend as the stabilizing arm 54 is moved from the vertical position to the operative position, shown in FIG. 4. In order to locate and retain the stabilizing arm 54 in its operative position, the mounting flanges 60 are formed with horizontal flats 66 that limit the downward pivotal movement of the arm 54 and locate it in proper operative position. The flats 66 also prevent further downward movement of the stabilizing arm 54 as a result of vibrations and forces incurred by the sleeve 36 and transmitted to the arm.

It will be seen that if the tubular insulating sleeve 36 is struck by items being loaded into or removed from the refrigerator, the stabilizing members 50 will tend to prevent movement of the tubular sleeve 36 relative to the light fixture 30, and hence, tend to prevent the force of such impact from engaging and damaging the light bulb 35. Moreover, since the stabilizing members 50 are interposed between the sleeve 36 and the light fixture base 31, the forces of such impact are transmitted to the base 31 of the light fixture via the stabilizing members, rather than to the relatively fragile sockets 34. Hence, the stabilizing members 50 have the effect of rigidifying the tubular sleeve 36 so as to enable it to both insulate the bulb 35 from the refrigerator temperatures within the cabinet, as well as protect the bulb from otherwise potentially damaging impact from items being loaded into and removed from the refrigerator shelves. Since the arms 54 of the stabilizing members 50 may be pivoted by hand between their operative position (FIGS. 3 and 4) and the inoperative position (shown in FIG. 5 and in phantom in FIG. 3), the tubular sleeve 36 and bulb 35 maybe easily removed in a customary manner to permit bulb replacement on a periodic basis as necessary.

From the foregoing, it can be seen that the refrigerator light fixture of the present invention is adapted to both insulate the light bulb from cold temperatures within the refrigerator cabinet and to protect it from damaging impact forces, without the use of a separate wire guard or the like. The light fixture also maybe mounted in close relation between the refrigerator door frame and shelving within the cabinet without modification to the shelving or door frame. It also is of relatively simple and economical construction and does not encumber removal and replacement of the light bulb.

I claim as my invention:

1. A refrigerator cabinet light fixture assembly comprising a base member for mounting within the refrigerator cabinet, said base member including an elongated vertical section and socket supports carried in transversely extending relation to said vertical section at vertically spaced apart locations, said socket supports each having a respective electrical socket, an elongated lamp bulb supported between said sockets in parallel spaced relation to the base member vertical section, an elongated plastic tubular sleeve extending substantially the length of said bulb in parallel relation to said base member vertical section, means supporting said tubular sleeve in concentric relation about said bulb for defining an air insulating space therebetween, and;

stabilizing means interposed between said base member vertical section and said tubular sleeve at a location intermediate the ends of said tubular sleeve and base member vertical section for preventing substantial relative movement between said sleeve and bulb along the entire length of the sleeve and for enabling said sleeve to protect said bulb from the damaging impact of forces striking the exterior or said sleeve.

2. The light fixture assembly of claim 1 in which said stabilizing means includes at least one stabilizing member affixed to said base member vertical section and having means for engaging and retaining said tubular sleeve and preventing movement of the sleeve relative to said base member vertical section.

3. The light fixture assembly of claim 2 in which said stabilizing member sleeve engaging and retaining means is an arm formed with a cylindrical recess for receiving and engaging a portion of the outer periphery of said sleeve.

4. The light fixture assembly of claim 3 in which said arm receiving recess is positionable is around about one half of the outer circumferential periphery of said tubular sleeve.

5. The light fixture assembly of claim 2 of which said stabilizing member includes a base fixed to said base member vertical section and a tubular sleeve engaging and retaining arm extending outwardly from said base.

6. The light fixture assembly of claim 5 including means supporting said arm for pivotal movement relative to said base between an operative tubular sleeve engaging and retaining position and a retracted position out of engagement with said tubular sleeve for permitting removal of said sleeve and bulb from said fixture.

7. The light fixture assembly of claim 6 in which said arm supporting means supports said arm for movement between an operative position in substantially perpendicular relation to said base and an inoperative position in substantially parallel relation to said base.

8. The refrigerator cabinet light fixture of claim 5 of which said base member vertical section is an elongated channel, and said stabilizing member base is formed with a channel recess that is positionable about said light fixture base.

9. The refrigerator cabinet light fixture of claim 1 in which said tubular sleeve supporting means includes an end-cap fitted into each end of said sleeve.

10. A refrigerator comprising a refrigerator cabinet a door assembly mounted within an opening in said cabinet, said door assembly including a door mounting frame having an outer peripheral portion about the cabinet opening, a plurality of insulated glass doors mounted for pivotal movement on said frame between open and closed positions, said frame including at least one mullion extending between top and bottom sides thereof and against which said doors close, display shelves mounted within said cabinet behind said doors upon which items may be supported and viewed through said doors while said doors are in closed position, a light fixture supported between said door frame and said shelves, said light fixture including a base member for mounting on said door frame, said base member including an elongated vertical section and socket supports carried in transversely extending relation to said vertical section at vertically spaced apart locations, said socket supports each having a respective electrical socket, an elongated lamp bulb supported between said sockets in parallel spaced relation to said base member vertical section, an elongated plastic tubular sleeve extending substantially the length of said bulb in parallel relation to said base member vertical section, means supporting said tubular sleeve in concentric relation about said bulb for defining an air insulating spaced therebetween, and;

stabilizing means interposed between said base member vertical section and said tubular sleeve at a location intermediate the ends of said tubular sleeve and base member vertical section for preventing substantial relative movement between said sleeve and bulb on the entire length of the sleeve and for enabling said sleeve to protect said bulb from the damaging impact of forces striking the exterior of said sleeve.

11. The refrigerator of claim 10 in which said base member vertical section is mounted on a rear side of said mullion.

12. The refrigerator of claim 10 in which said stabilizing means includes at least one stabilizing member affixed to said base member vertical section and having means for engaging and retaining said tubular sleeve and preventing movement of the sleeve relative to said base member vertical section.

13. The refrigerator of claim 12 in which said stabilizing member sleeve engaging and retaining means is an arm formed with a cylindrical recess for receiving and engaging a portion of the outer periphery of said sleeve.

14. The refrigerator of claim 13 in which said arm receiving recess is positionable is around about one half of the outer circumferential periphery of said tubular sleeve.

15. The refrigerator of claim 12 of which said stabilizing member includes a base fixed to said light fixture base member vertical section and a tubular sleeve engaging and retaining arm extending outwardly from said base.

16. The refrigerator of claim 15 including means supporting said arm for pivotal movement relative to said base between an operative tubular sleeve engaging and retaining position and a retracted position out of engagement with said tubular sleeve for permitting removal of said sleeve and bulb from said fixture.

17. The refrigerator of claim 15 of which said base member vertical section is an elongated channel, and said stabilizing member base is formed with a channel recess that is positionable about said light fixture base member vertical section.

18. A refrigerator cabinet light fixture assembly comprising an elongated base member for mounting within the refrigerator cabinet, a socket support at opposite ends of said base member each having a respective electrical socket, an elongated lamp bulb supported between said sockets, an elongated plastic tubular sleeve, means supporting said tubular sleeve in concentric relation about said bulb for defining an air insulating space therebetween, stabilizing means intermediate the ends of said tubular sleeve for preventing relative movement between said sleeve and bulb and for enabling said sleeve to protect said bulb from the damaging impact of forces striking the exterior or said sleeve, said stabilizing means including at least one stabilizing member having a base fixed to said light fixture base member and a tubular sleeve engaging and retaining arm extending outwardly from said base, and said stabilizing member base having a pair of arm supporting flanges formed with upwardly opening slots having a width corresponding substantially to the thickness of said arm for snuggly receiving and retaining said arm and for supporting said arm for pivotable movement relative to said base between an operative sleeve engaging and retaining position in substantially perpendicular relation to said light fixture base member and a retracted, inoperative position in substantially parallel relation to said base member out of engagement with said tubular sleeve for permitting removal of said sleeve and bulb from said fixture.

19. The light fixture assembly of claim 18 of which said arm supporting flange slots each have an enlarged cylindrical bottom for facilitating pivotal movement of the arm relative to the respective flange.

20. The light fixture assembly of claim 18 in which said flanges are formed with substantially horizontal flats for locating said arm in perpendicular relation to the base when the arm is in said operative sleeve engaging and retaining position.

* * * * *